United States Patent [19]

Furman

[11] 4,191,535

[45] Mar. 4, 1980

[54] COAL EXTRUSION APPARATUS AND PROCESS

[75] Inventor: Anthony H. Furman, Schenectady, N.Y.

[73] Assignee: General Electric Company, Schenectady, N.Y.

[21] Appl. No.: 945,442

[22] Filed: Sep. 25, 1978

[51] Int. Cl.[2] ..... C10L 5/00; C10L 5/22

[52] U.S. Cl. ..... 44/10 R; 44/13; 425/107

[58] Field of Search ..... 44/10 R, 2, 11-13; 425/107

[56] References Cited

U.S. PATENT DOCUMENTS

| | | | |
|---|---|---|---|
| 1,597,102 | 8/1926 | Navone | 425/107 X |
| 1,780,629 | 11/1930 | Otto | 425/107 |
| 2,443,289 | 6/1948 | Bailey | 425/107 X |
| 3,989,433 | 11/1976 | Furman | 425/149 |
| 4,025,262 | 5/1977 | Furman | 425/145 |
| 4,049,390 | 9/1977 | Furman | 44/10 R |
| 4,049,392 | 9/1977 | Furman | 44/10 R |

*Primary Examiner*—Carl F. Dees

*Attorney, Agent, or Firm*—Richard G. Jackson; Joseph T. Cohen; Paul R. Webb, II

[57] ABSTRACT

An improved extrusion apparatus and process are described for the preparation of a rod-like body from a coal-containing particulate mixture. Improvements are disclosed for depositing lubricant directly onto the outer surface of the forming body as it is passed into a die received over a discharge portion of the extruder barrel. Reductions in requisite power input to the extruder are thereby effectuated.

16 Claims, 3 Drawing Figures

COAL EXTRUSION APPARATUS AND PROCESS

BACKGROUND OF THE INVENTION

The present invention relates to an improved apparatus and process for the extrusion of a rod-like coal-containing body.

Extrusion apparatus and processes for the preparation of a cohesive, continuous, rod-like body from a coal-containing particulate mixture are well-known in the art. One type of such apparatus includes an extruder screw disposed within an extruder barrel. Means (e.g. a feed hopper) connected to the barrel are provided for feeding a mixture containing powdered or finely divided coal and a binder therefor into the barrel at an upstream location thereof. Die means are connected to a discharge or downstream portion of the barrel for receiving and shaping the mixture forcibly discharged from the barrel portion. Means (e.g. a motor-driven shaft) are operatively associated with the screw for driving it. For some applications, means are provided adjacent the barrel for heating at least a portion thereof. This type of apparatus may further include means positioned downstream of the die means for severing the emerging rod-like body.

In a related process for the extrusion of a rod-like coal-containing body of the above-described type, the feed mixture is fed into the barrel adjacent one end thereof. The mixture is moved through the barrel by the rotation of the extruder screw and is forcibly discharged from the downstream end thereof through the die means.

Apparatus generally of the foregoing type is described by Furman in U.S. Pat. Nos. 4,025,262 and 4,049,392. In those patents, control means are disclosed for adjusting the length of the consolidating coal-containing mixture in contact with the surface of the die in response to selected parameters. The die means is of substantially constant or uniform cylindrical configuration and provision is made for relative movement between the die means and the screw. In Furman, U.S. Pat. Nos. 3,989,433 and 4,049,390, there is described apparatus of the foregoing type, which further includes movable die wall portions (e.g. pivotally mounted elements) referred to therein as "flappers" for automatically controlling the throughput resistance experienced by the rod-like body. All of the foregoing patents are incorporated herein by reference.

The inventions described in the above-cited patents are substantial advances in the art. However, there is room for further improvement in coal extrusion apparatus of the above-described type and in coal extrusion processes which may be carried out therein. Such apparatus may be employed in a variety of commercially attractive applications wherein it is desired to extrude the rod-like coal-containing body against high back pressure. In one such application, the extruder apparatus is used for charging a coal gasifier operated at superatmospheric pressure (e.g. up to 10 atmospheres or more). In such applications the power input required for driving the extruder screw often tends to become undesirably high.

It has been found by practice of the present invention that such advantageous apparatus and process are provided, whereby the requisite power input is reduced for any given extrusion rate. In the present process and apparatus, a lubricant is deposited directly onto the outer surface of the rod-forming mixture as it passes into the die. In this manner, the present invention performs the function of reducing the frictional forces exerted by the wall of the die on the rod-like body being formed therein to effectuate reduced power consumption, a result which eluded heretofore proposed structures and processes wherein lubricant was introduced into the interior of the mixture employed.

DESCRIPTION OF THE INVENTION

Generally stated, the present invention provides, in one aspect thereof, an improved apparatus for the extrusion of a cohesive, continuous rod-like coal-containing body. In such aspect this invention provides, in extrusion apparatus of the above-described type, an improvement comprising in combination therewith, means for depositing a film of lubricant directly onto the outer surface of the forming body as it passes from the barrel into the die means.

In a preferred embodiment, the die means, which may be of substantially constant cylindrical internal cross-section, is disposed with a portion of the inner surface thereof received over the outer wall surface of the barrel discharge portion and spaced radially outwardly therefrom to define an annular gap therebetween. In this embodiment, the lubricant depositing means is defined in part by the gap and in part by distribution means (e.g. an annular recess provided in at least one of the die means and the barrel discharge portion with the recess opening into the gap). The distribution means is provided for distributing a flow of lubricant into at least substantially the entire circumference of a circumferential portion of the gap at a distribution location upstream from the downstream end of the barrel discharge portion. A connecting means (e.g. one or more passages) is preferably provided for connecting the recess in flow communication with an assembly for supplying flowable lubricant to the recess via the connecting means. Lubricant is supplied under sufficient pressure to fill the recess and flow therefrom into and through the gap, from which the lubricant is deposited as a film directly onto the outer surface of the developing rod-like coal-containing body as it passes into the die. A sealing means (e.g. a sealing ring) is provided for sealing the gap at a location upstream from the distribution location associated with the recess and gap.

In another aspect, this invention provides an improvement in the above-described process for extrusion of a rod-like coal-containing body. In the improved process, generally stated the improvement includes the step of depositing a film of lubricant directly onto the outer surface of the forming body as it passes into the die means.

BRIEF DESCRIPTION OF THE DRAWING

Practice of the present invention will be more fully understood by having reference to the following detailed description taken with the accompanying drawing, which schematically illustrates the present invention and (in FIGS. 1 and 2) the best mode contemplated for carrying it out.

In the drawing, wherein like numerals refer to similar elements throughout.

DETAILED DESCRIPTION OF THE INVENTION AND MANNER AND PROCESS OF MAKING AND USING IT

Figure 1:
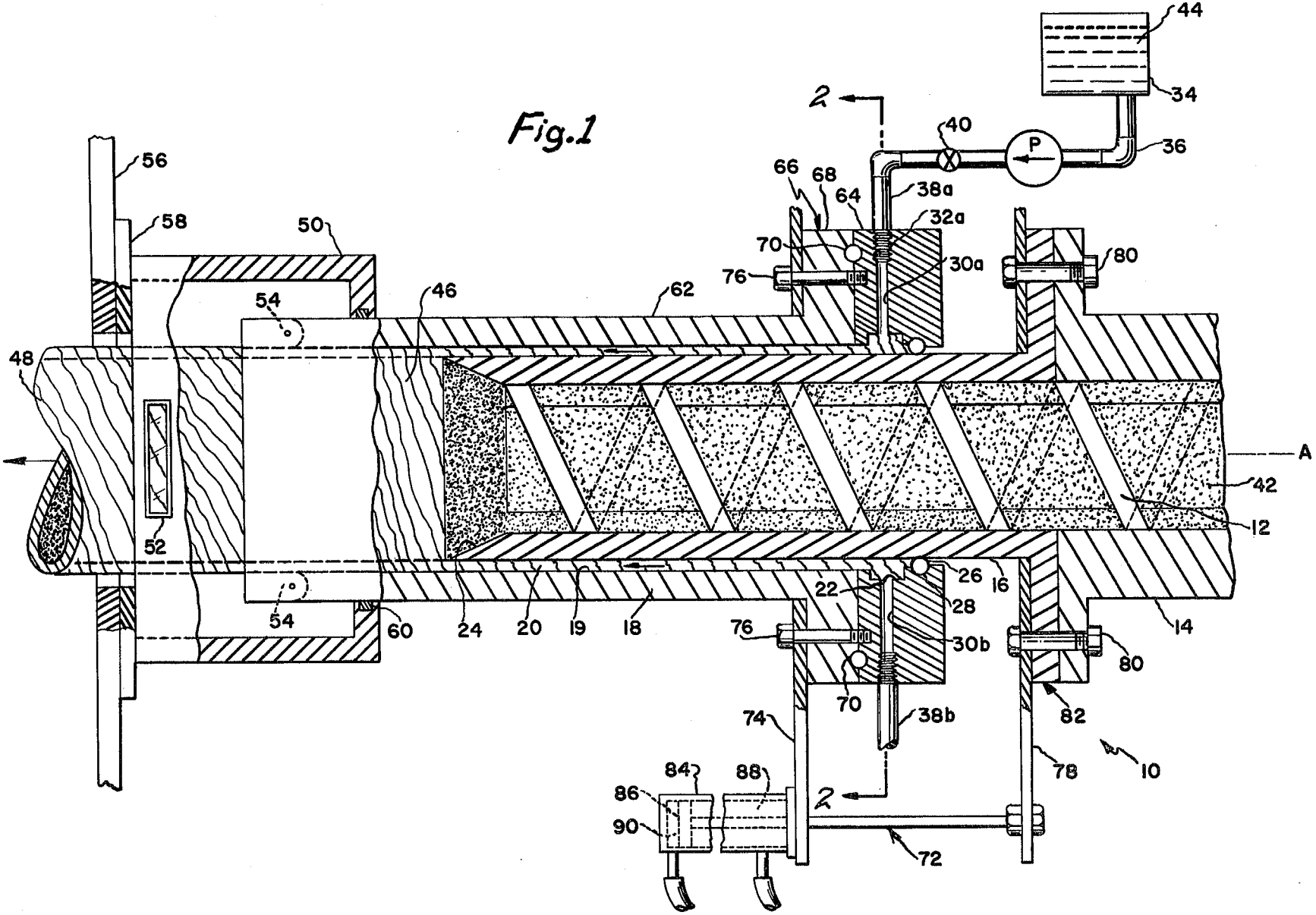
FIG. 1 is a fragmentary elevation view, partly in section, illustrating improved coal extrusion apparatus embodying the present invention.

Referring now to the drawing and particularly to FIG. 1 thereof, there is shown improved extrusion apparatus 10 of the present invention including extruder screw 12 disposed within extruder barrel 14 provided with extension 16 which serves as the barrel discharge portion. If desired, barrel 14 and extension 16 may be of unified or integral construction, rather than as joined pieces. However, the construction shown facilitates replacement of the barrel discharge portion, which is subject to relatively greater wear. Means (not shown), e.g. a motordriven shaft or the like, are operatively associated with the screw for driving it. Suitable driving means (including a motor and a variable speed control) are shown in U.S. Pat. No. 4,025,262.

Die means 18, preferably of substantially constant or uniform cylindrical internal cross-section, is disposed with a portion of the inner surface 19 thereof received over the outer wall surface of barrel portion 16, preferably in telescoping relationship therewith. The received inner surface of the die is spaced radially outwardly from the outer surface of barrel portion 16 to define therebetween annular gap 20 adapted to conduct a flow of lubricant therethrough. The die 18 is provided with generally annular cavity or recess 22 opening into the gap at a lubricant distribution location upstream from downstream end 24 of the barrel discharge portion. (As used in this description the terms "downstream" and "upstream" refer to locations or directional senses toward the left and toward the right, respectively, in FIGS. 1 and 3.)

Sealing ring 26, which may be and preferably is a resilient O-ring formed of rubber or other elastomeric material, is provided for sealing the gap at a location upstream from the distribution location associated with the recess and gap. If, as preferred, the die and barrel discharge portion are arranged for axial movement relative one to another (as described in U.S. Pat. No. 4,025,262), sealing ring 26 is preferably secured to the die with a radially inner portion of the sealing ring free to both slide along and sealingly engage the radially outer surface of the barrel discharge portion. Such secured ring-to-die relationship can be effected by providing annular groove 28 in the die and securing the ring therein by an interference fit therebetween. The sealing ring aids in directing a flow of lubricant from the recess through the gap to its intended downstream destination, as hereinafter described.

The die includes at least one passage 30 in flow communication with the recess and extending therefrom through the die to, and terminating in, port 32 in the external surface of the die. The port is adapted, as, for example, by female pipe threads, for connecting the port end of the passage in flow communication with a flowable lubricant supply means or system. A suitable supply system, shown in FIG. 1 for passage 30A, includes container 34, which is adapted for receiving, holding, and dispensing the flowable lubricant. The system further includes pump P having its inlet connected by inlet conduit 36 to the container and having its outlet connected to the port via conduit 38 provided with valve 40.

Recess 22 serves to distribute a flow of lubricant, supplied thereto via at least one passage 30, into at least substantially the entire circumference of the circumferential portion of gap 20 to which the recess opens. Such distribution or introduction function may best be performed when the recess is filled with lubricant throughout its circumferential extent.

Figure 2:
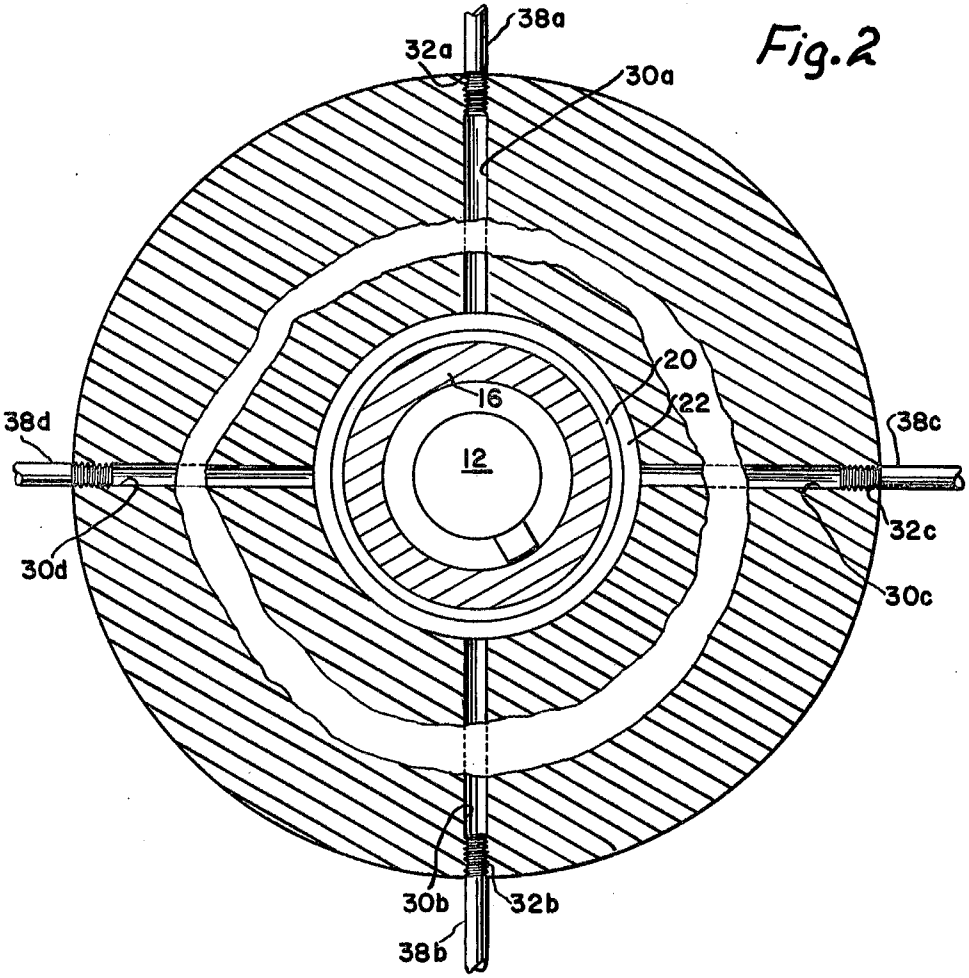
FIG. 2 is an enlarged partial sectional view taken on line 2—2 of FIG. 1.

The recess-filled condition may be facilitated by employing a plurality of two or more and preferably four or more passages 30, each extending from a separate mouth of the recess to a port in the external surface of the die. Where a plurality of passages is provided, the mouths of the recess from which the passages extend are desirably spaced substantially circumferentially apart, preferably by a substantially uniform angular distance one from another. For example, FIG. 1 shows two passages **30*a* and 30*b* extending from corresponding mouths of the recess with the mouths spaced about 180° apart, while in FIG. 2 four passages (designated 30*a*, 30*b*, 30*c*, and 30*d*) are shown with each corresponding recess mouth spaced about 90° from its closest neighboring mouths. Where a plurality of passages 30 is provided, each passage is preferably connected in flow communication with a separate lubricant supply system, only one of which is shown in FIG. 1 (as described above with reference to passage 30*a*). Like systems associated with passages 30*b*, 30*c* and 30*d* are partially illustrated by conduits 38*b*, 38*c* and 38*d*** (each shown in fragmentary view for simplicity).

The recess-filled condition aids in achieving the desired condition of the annular gap being filled with lubricant flowing therethrough. A lubricant-filled gap, in turn, aids in depositing the lubricant discharged therefrom onto the forming coal-containing rod-like body in a manner such that a substantially continuous film is formed entirely about the circumfernece of the forming body as it enters the die (as hereinafter described).

Development of the filled-gap condition and resulting deposition of a continuous film on the developing rod-like body are further aided by employing a gap having a longitudinal extent of at least about 0.5 inch and preferably at least about three inches in length, as measured from the downstream end of the barrel dischrage portion to the downstream end of the distribution location (e.g., the downstream end of recess 22). The gap may be of any suitable annular thickness, for example, 5 mils or more and preferably 10 mils or more. In general, gaps having annular thickness of at least about 5 mils result in more uniform film deposition over a wide range of lubricant viscosity. Although gaps having annular thickness greater than 50 mils may be employed herein, the corresponding additional amount of lubricant required for operating in the preferred gap-filled condition generally provides insufficiently increased benefits to justify the resulting additional cost.

In operation, a particulate mixture comprising powdered or finely divided coal and a binder therefor is introduced into barrel 14 from feed means (e.g., a feed hopper not shown) in flow communication with an upstream feed introduction region (also not shown) thereof, which preferably is adjacent the upstream end of the barrel. A suitable feed hopper and its relationship to an extruder barrel are shown in the referenced U.S. Pat. No. 4,025,262 (hereinafter Furman I). The introduced mixture is moved downstream under the action of the flights of extruder screw 12 (as it is rotated by its driving means) and is forcibly discharged from tapered downstream end 24 of barrel portion 16 into die 18. Concurrently with such movement of the mixture, pump P draws a flow of lubricant 44 from container 34 through pump inlet conduit 36 and forces the flow sequentially through discharge conduit 38*a*, passage 30*a*, and into annular recess 22, thereby filling the recess with lubricant being passed therethrough. Under the pressure developed by the pump, the lubricant flow continues from the recess with the lubricant being distributed therefrom into substantially the entire circumference of the circumferential portion of the gap contiguous to the circumferentially extending opening of the recess. The lubricant flow introduced into the gap fills the gap and is passed downstream therethrough to the downstream end thereof, which surrounds the downstream end of barrel discharge portion 16. Continued flow of the lubricant effects discharge thereof from the gap into the region between the die 18 and the mixture 42 as it is passed from barrel portion 16 into the die, typically resulting in deposition of lubricant film 46 directly onto the outer surface of the forming rod-like body. In the die, by the combined action of force supplied by extruder screw 12 and the friction developed between the lubricant-coated moving coal-containing mass and the inner surface of the die, consolidation of the mixture into a rod-like body is completed.

At various stations along the length of the extruder barrel and the die, means (not shown) such as those described in U.S. Pat. No. 4,025,262 may be included for selectively and controllably heating or cooling the coal-containing mixture as it is moved through the extruder barrel and consolidated in the die. Such means may further be employed for controlling the temperature of the lubricant flowing through the gap.

As the lubricant-coated, rod-like coal-containing body 48 emerges from die 18 optionally terminating within housing 50, the condition of the coating may be ascertained by visual examination thereof through sealed sight port 52. If the emerging rod-like body is insufficiently coated with the lubricant film, the rate of lubricant addition may be increased and vice versa.

If the density of the emerging body is too dense or insufficiently dense, as may be visually determined, for example, if the lubricant film is transparent, appropriate adjustments may be made. For example, density-controlling adjustments may be made in the positions of optionally included movable die wall portions or flappers 54 as described in above-referenced U.S. Pat. Nos. 3,989,433 and 4,049,390. Alternatively or jointly, relative axial movement between the die means and the extruder barrel may be effected as described in Furman I, where, as preferred, provision is made therefor in the improved extruder of this invention.

If desired, the lubricant-coated, rod-like body may be discharged from the die into a chamber, schematically illustrated by wall 56, for use as is or for further treatment prior to ultimate use. Thus, wall 56 may be the wall of a chopper mechanism including a guillotine blade for subdividing the rod into briquettes as described in Furman I. If improved extruder apparatus 10 is used for charging a coal gasifier, the rod may be directly advanced into the gasifier, in which event wall 56 schematically represents a wall thereof. Alternatively, the rod may first be subdivided into briquettes, which may then be passed directly into the interior of the gasifier, in which case the interior of the chopping mechanism is exposed to the pressure and temperature conditions of the gasifier and is constructed accordingly. In either case, the die means 18 is exposed to such gasifier conditions and accordingly gasket 58 is preferably provided between housing 50 and wall 56 to form a gas-tight seal therebetween. In addition, high-pressure sealing ring 60 is provided between at least a portion of housing 50 and opposing surface regions of die 18.

In general, a minimum length of available die-to-coal body interface is required to sufficiently compact the body being consolidated in the die such that the body itself provides substantially gas-tight sealing of the gasifier from the extruder. Provision of a lubricant film on the surface of the body passing through the die reduces the extruder power input required to overcome the frictional resistance of the die to such passing. Advantageously, the lubricant film deposited onto the body further aids in sealing the gasifier from the extruder. Using a lubricant composed of aqueous 6% bentonite, successful extrusion operations against gasifiersimulating back pressure of 300 PSIG have been successfully tested. Comparative testing showed that operation at pressures up to 325 PSIG was successful with 230 pounds of coal-containing body per kilowatt hour input to the extruder screw and 1200 pounds per hour rod delivery, while, in comparison, operation at the same exposed die surface area and control flapper positions resulted in a jammed die soon after the lubricant addition was terminated.

If the recess and one or more passages are provided in the die, they may be provided in any suitable portion of the die so long as the recess opens into the gap as herein taught. For example, the recess-and-passage system may be provided in an upstream region of generally cylindrical die body portion 62 (a non-illustrated embodiment). However, in the preferred embodiment illustrated in FIG. 1, the portion of die 18 in which recess 22 and the one or more passages 30 are provided is ring 64, which forms a part of die shoulder assembly 66 further including die shoulder 68 as another part thereof. The ring 64 may be formed integrally with die shoulder 68 or (as shown) as a separate piece joined thereto with seal means illustrated be recessed O-ring 70 forming a seal therebetween.

If desired, extrusion apparatus 10 may include means operatively associated with die 18 and barrel discharge portion 16 for effecting relative axial movement therebetween to controllably vary the extent of internal surface area of the die available for contact with the lubricant-coated consilidating coal-containing mixture. Shown in FIG. 1 is a suitable relative movement assembly or mechanism 72 including annular die plate 74 secured by a plurality of fasteners 76 to die shoulder assembly 66 and annular barrel plate 78 secured by a plurality of fasteners 80 to barrel shoulder assembly 82 (formed by adjoining annular shoulder portions of barrel 14 and its extension 16). Movement mechanism 72 preferably includes two or more die actuator hydraulic cylinders 84 (one shown), each containing a stationary piston 86 affixed to barrel plate 78. In the manner described in Furman I, hydraulic fluid can be introduced under pressure into one of regions 88 and 90 and simultaneously withdrawn from the other region, thereby effecting a corresponding reversibly downstream or upstream movement of barrel portion 16 relative to die 18 and resulting in control of the density of lubricant-coated coal-containing body 48.

Figure 3:
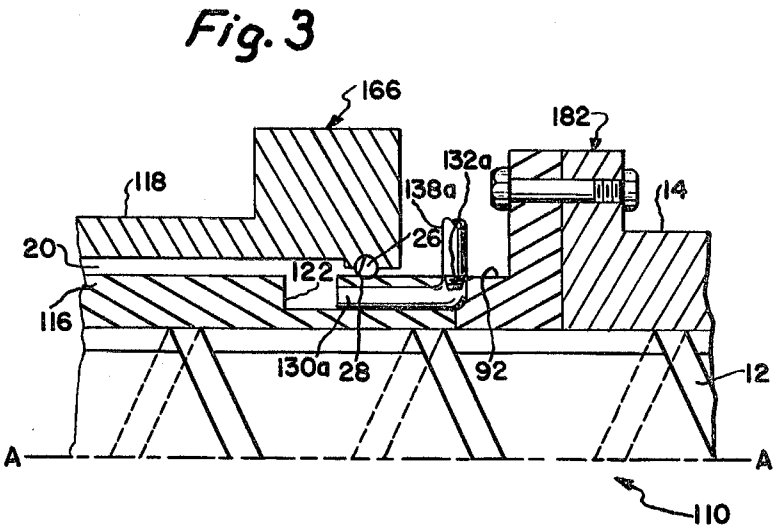
FIG. 3 is a fragmentary elevation view, partly in section, illustrating another embodiment of the improved apparatus.

In another embodiment, the present invention provides extrusion apparatus 110 (a longitudinal fragment thereof bordered below by screw axis A—A being shown, partly in section, in FIG. 3), which apparatus may be substantially identical to extrusion apparatus 10 (shown in FIGS. 1 and 2) except as hereinafter described. In FIG. 3, components which may be identical to components of apparatus 10 are designated by like numerals (e.g. screw 12), while each component of the embodiment shown in FIG. 3 which differs in some material respect from the corresponding component of apparatus 10 is designated by a corresponding number of the 100 series arrived at by adding 100 to the numeral used in connection with apparatus 10.

Thus, extrusion apparatus 110 includes barrel extension or discharge portion 116 in which is provided generally annular cavity or recess 122 opening into gap 20 defined by the extension and a portion of die 118 spaced radially outwardly therefrom. In apparatus 110, gap sealing ring 26 may be secured in annular groove 28 provided in die 118. Barrel extension 116 is provided with at least one passage 130, illustrated by passage **130*a* in flow communication with recess 122 and extending therefrom through the barrel extension to, and terminating in, port 132*a* in the external surface of the extension. Port 132*a* is adapted to connect the port end of passage 130 *a* in flow communication with a flowable lubricant supply system such as that illustrated in FIG. 1 and schematically represented by conduit 138*a* in FIG. 3. For improved ease of construction barrel shoulder portion 182 may be formed with extension shoulder 92 formed separately from, and joined to, the remainder of barrel extension 116. O-ring 70 (FIG. 1) is not required in the integral or unified shoulder 166 of apparatus 110. Operation of apparatus 110 may be substantially as described hereinabove for preparing lubricant-coated rod-like coal-containing body 48 by use of apparatus 10**.

Any suitable lubricant may be employed in the improved apparatus and process of this invention. Suitable lubricants include, for example, tar, mixtures of tar and oil, petroleum wax, water, and aqueous dispersions of bentonite. Aqueous dispersions containing from about 0.04 to about 0.20 part by weight bentonite (more preferably about 0.06 part by weight bentonite) per one part by weight water are preferred. In general, aqueous bentonite dispersions within the aforesaid preferred concentration range may be deposited in an amount, for example, from about 0.001 to about 0.004 (preferably about 0.002) pound per one square inch of the surface of the rod-like body being formed.

The preferred structural material for the various components of the apparatus of this invention is steel unless otherwise indicated herein. In general, the preferred recess width and radial thickness or depth are each about 0.25 inch, respectively.

BEST MODE CONTEMPLATED

The best mode contemplated for carrying out this invention has been set forth in the description above, for example, by way of setting forth preferred structural arrangements and dimensions, materials of construction, lubricant compositions and operating conditions, including but not limited to preferred ranges and values of amounts and other unobvious variables material to successfully practicing (including making and using) the invention in the best way contemplated at the time of executing this patent application.

It is understood that the foregoing detailed description is given merely by way of illustration and that many modifications may be made therein without departing from the spirit or scope of the present invention.

What is claimed is:

1. In an apparatus for extruding a cohesive, continuous rod-like coal-containing body including:

(a) an extruder barrel, (b) an extruder screw disposed within said barrel, (c) means for feeding a mixture containing powdered coal and a binder therefor into said barrel, (d) means operatively associated with said screw for driving said screw, and (e) die means operatively associated with and disposed adjoining the discharge portion of said barrel for receiving and shaping the mixture forcibly discharged from said barrel discharge portion, the improvement comprising, in combination with the above, (f) means for depositing a film of lubricant directly onto the outer surface of the forming body as it passes directly from said barrel into said die.

2. The improved apparatus of claim 1 wherein said lubricant depositing means is defined at least in part by (A) the die means being disposed with at least a portion of the inner surface thereof received over the outer wall surface of said barrel discharge portion and spaced radially outwardly therefrom to define an annular gap therebetween, (B) means for distributing a flow of lubricant into substantially the entire circumference of a circumferential portion of said gap at a distribution location upstream from the downstream end of said barrel discharge portion, and (C) means for sealing said gap at a location upstream from said distribution location.

3. The improved apparatus of claim 2 wherein said lubricant distribution means inlcudes (I) an annular recess provided in at least one of said die means and said barrel discharge portion, said recess opening into said gap at said distribution location, and (II) means for connecting the recess in flow communication with means for supplying flowable lubricant to said connecting means such that flowable lubricant received into said recess via said connecting means is distributed from substantially the entire circumference of said recess into said gap.

4. The improved apparatus of claim 3, wherein said connecting means includes at least one passage extending from said recess through that one of said die means and said barrel discharge portion in which said recess is provided to a port in the external surface of said recess-containing member, said port being adapted for connecting said passage in flow communication with said lubricant supply means.

5. The improved apparatus of claim 4, wherein there is included a plurality of two or more of said passages, with the mouths of the recess from which the passages extend being spaced substantially circumferentially apart by a substantially uniform distance one from another.

6. The improved apparatus of claim 2 wherein the longitudinal extent of said gap from the downstream end of said barrel discharge portion to said distribution location is at least about 0.5 inch in length.

7. The improved apparatus of claim 2 wherein said gap is at least about 5 mils in thickness.

8. The improved apparatus of claim 3 wherein said recess is provided in said die means.

9. The improved apparatus of claim 8 wherein said die means and said barrel discharge portion are arranged for axial movement relative one to another, said apparatus further including means operatively associated with said die means and said barrel discharge portion for effecting said relative axial movement.

10. The improved apparatus of claim 3 wherein said recess is provided in said discharge barrel portion.

11. The improved apparatus of claim 4, further including a lubricant supply container operatively associated with said recess for receiving and dispensing said lubricant, a pump in flow communication with said container for effecting said dispensing, and a conduit placing the pump discharge in flow communication with said port.

12. In a process for extruding a cohesive, continuous rod-like coal-containing body wherein a mixture containing powdered coal and a binder therefor is fed into an extruder barrel adjacent one end thereof, said mixture is moved through said barrel by the rotation of an extruder screw disposed therein and is forcibly discharged from the downstream end of said barrel directly through die means, the improvement comprising the step of depositing a film of lubricant directly onto the outer surface of the forming body as it passes into said die means.

13. The improved process of claim 12 wherein said depositing step includes filling an annular gap defined by an overlapping spaced apart relationship between the barrel discharge portion and a portion of the inner surface of said die means, and the annular flow of lubricant leaving said gap is deposited directly onto said outer surface.

14. The improved process of claim 13 wherein the lubricant is selected from the group consisting of an aqueous dispersion of bentonite, tar, a mixture of tar and oil, petroleum wax, and water.

15. The improved process of claim 14 wherein said lubricant is an aqueous dispersion containing about 0.04 to about 0.20 part bentonite per part water.

16. The improved process of claim 15 wherein the dispersion is deposited in an amount corresponding to from about 0.001 to about 0.004 pound per one square inch of the rod-like body surface.

* * * * *